United States Patent [19]

Angarola

[11] 4,080,082

[45] Mar. 21, 1978

[54] IMPROVED STRAP SEAL BY STRAP TENSIONER WITH AUTOMATIC CUT-OFF

[75] Inventor: Barry R. Angarola, Schaumburg, Ill.

[73] Assignee: Signode Corporation, Glenview, Ill.

[21] Appl. No.: 660,148

[22] Filed: Feb. 23, 1976

Related U.S. Application Data

[62] Division of Ser. No. 556,268, Mar. 7, 1975, Pat. No. 4,041,993.

[51] Int. Cl.[2] ..... B21F 15/04

[52] U.S. Cl. ..... 403/285; 24/23 W; 140/93.2; 403/393

[58] Field of Search ..... 24/25, 23 W, 22, 20 W, 24/20 EE, 20 R, 21, 23 R; 140/93.2, 93.4; 403/393, 110, 285, 282, 278

[56] References Cited

U.S. PATENT DOCUMENTS

| | | | |
|---|---|---|---|
| 1,283,062 | 10/1918 | Brooks | 24/23 W |
| 2,040,576 | 5/1936 | Timmerbeil | 140/93.2 |
| 2,204,354 | 6/1940 | Hansen | 403/110 |
| 2,214,109 | 9/1940 | Ott | 24/23 W |
| 2,895,193 | 7/1959 | Ridgers | 24/20 EE |
| 3,222,777 | 12/1965 | Rutter et al. | 24/21 X |
| 3,349,442 | 10/1967 | Buy | 24/23 W |
| 3,380,485 | 4/1968 | Plattner et al. | 140/93.4 |

*Primary Examiner*—Andrew V. Kundrat
*Attorney, Agent, or Firm*—Dressler, Goldsmith, Clement, Gordon & Shore, Ltd.

[57] ABSTRACT

A strapping tool for tensioning and shearing strap has a tensioning wheel, a ratchet wheel means associated with the tensioning wheel, and a pawl adapted to engage the ratchet wheel means when the tensioning wheel is rotated in a direction opposite to the tensioning direction. When the pawl is engaged, the ratchet wheel drives a single stroke cut-off mechanism. A latch means is provided to place the pawl into engagement with the ratchet wheel. A pawl positioning means connects the latch means and the pawl, and releases the pawl from engagement with the ratchet wheel means as a cut-off stroke is executed. The strapping tool is further provided with a cutting block which has a chamfer along the cutting edge of the block so that the edge of the cut strap is bent downwardly upon being cut, and wear on the cutting edge is minimized as the strap is tensioned.

4 Claims, 7 Drawing Figures

IMPROVED STRAP SEAL BY STRAP TENSIONER WITH AUTOMATIC CUT-OFF

This is a division of application Ser. No. 556,268, filed 7 Mar., 1975, and now U.S. Pat. No. 4,041,993.

BACKGROUND OF THE INVENTION

When a package is secured by a strap, the package is circumscribed by the strap so that the strap has overlapping portions. These overlapping portions are enclosed in a seal structure, the strap is tensioned to a preselected tautness about the package, the seal is crimped about the overlapping strap portions to secure the overlapping strap portions together, and the excess strap situated externally of the seal is cut off or sheared. In this manner continuous strap which may be supplied from a reel can be used.

Illustrative prior art tensioning and shearing tools include those shown in U.S. Pat. No. 3,150,694 to Meier wherein the shearing mechanism includes a driving cylinder-piston assembly which is energized by opening a valve so that air is supplied to the cylinder to move the piston and the piston rod. The strap is sheared along the edge of the seal without using a cutting block.

Another prior art tensioning and shearing tool is disclosed in U.S. Pat. No. 3,028,885 to Leslie et al., wherein a first handle is moved to actuate the tensioning mechanism, and a second handle is provided to operate the shearing mechanism. Shearing is effected by rotating the second handle, to which a cutter is pivotally connected, thereby severing the strap between the cutter blade and the straight cutting edge of a cutting block. The second handle is biased toward the off-position by a handle spring, but the second handle can be operated any number of times before a subsequent tensioning operation is initiated.

SUMMARY OF THE INVENTION

The present invention contemplates a strapping tool for tensioning and shearing strap wherein the strap tensioning assembly is utilized also to energize the strap cutting mechanism. The tool is provided with a tensioning wheel, a ratchet wheel means driven simultaneously with the tensioning wheel, and a pawl means which initiates strap cut-off. The pawl means is adapted to be engaged by the ratchet wheel means when the tensioning wheel is rotated in a direction opposite to the tensioning direction. The pawl means is linked to a cutter-blade which coacts with a cutting block. A pawl positioning means, which may be a spring, is connected at one end to the pawl means and at the other end to a pivotal lobe means. Cut-off is effected by shifting the lobe means from an off-position to an on-position so that the pawl positioning means biases the pawl means in engagement with the ratchet wheel and in a position to actuate the cutter blade. The cut-off stroke is initiated by driving the tensioning wheel in a direction opposite to the tension direction, preferably by means of a reversible air motor.

During the cut-off cycle, the lobe means is automatically returned to the off-position so that the cut-off cycle cannot be repeated inadvertently. Cut-off occurs through the interaction of the ratchet wheel means with the pawl means which, in turn, is linked with the cutter blade. During the cut-off stroke, a projection on a linkage connecting the pawl means with the cutter blade engages a cam surface on the lobe means and automatically returns the lobe means to the off-position, thereby insuring that only a single cut-off stroke occurs each time the lobe means is shifted to the on-position. At the end of the cut-off stroke the pawl means abuts a stop which causes the pawl means to disengage from the ratchet wheel.

The cutting block has a cutting edge transverse to the tensioning direction of the strap and preferably faces toward the tensioning wheel. The cutting block has a chamfer at one end of the upper face thereof and along the cutting edge. Overlapping strap portions are fed into the tool so that the cutting block is positioned therebetween. Thus the chamfer causes the cut edge of the strap, which is relatively sharp, to bend downwardly upon being cut so that exposure of the sharp edge of the strap is minimized. The chamfer also minimizes wear of the cutting edge on the cutting block during the strap tensioning operation because the strap is kept away from the cutting edge until such time when a strap segment has to be cut off.

DESCRIPTION OF THE PREFERRED EMBODIMENTS

Figure 1:
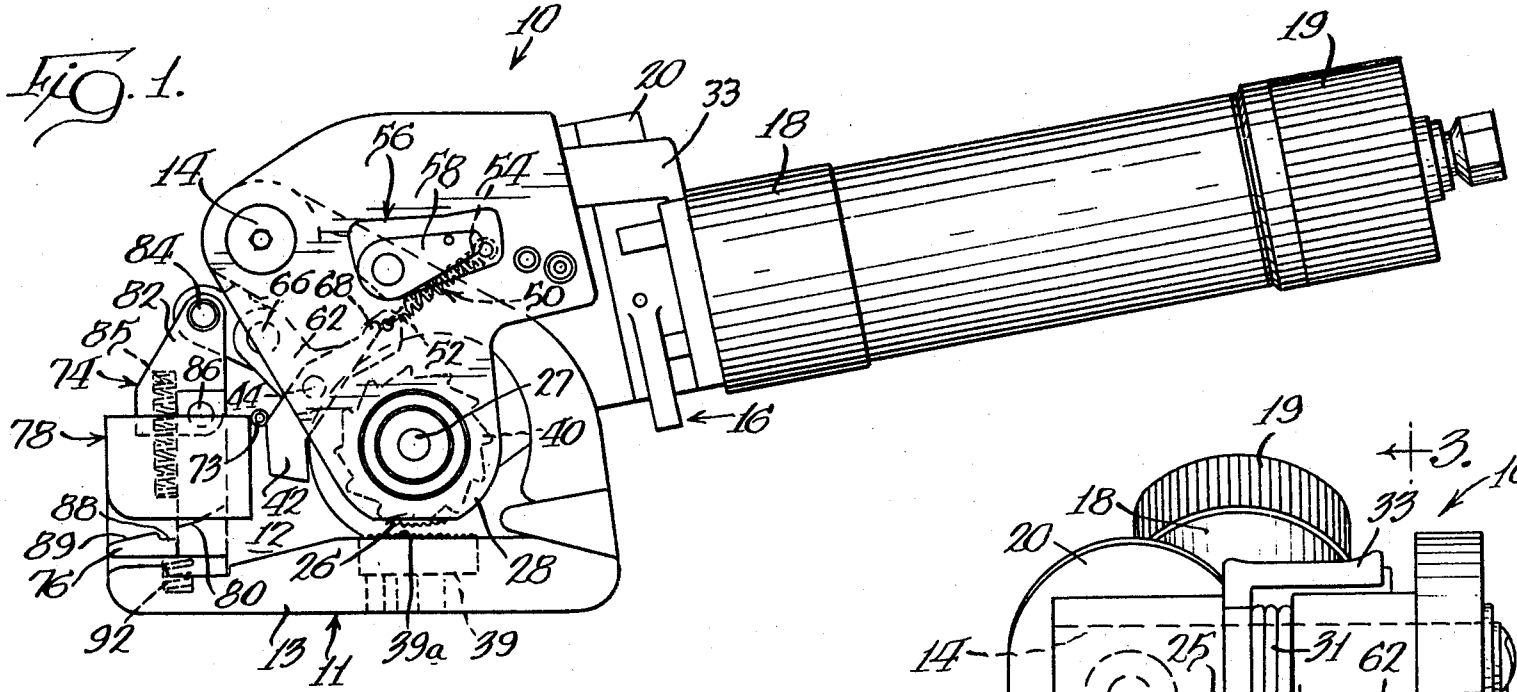
FIG. 1 is a side elevational view of a strap tensioning and cutting tool of the present invention.

Referring to the Figures, there is illustrated an integrated strap tensioning and shearing tool embodying the present invention. While the tool is intended primarily for use with steel strap, the tool can also be utilized with plastic strap and the like.

Tool 10 has a main frame 11 having upright portion 12 and base portion 13. Pivot shaft 14 is mounted on upright portion 12 of frame 11 and carries tensioning assembly 16 pivotally mounted thereon.

Tensioning assembly 16 includes a pneumatic motor means 18 controlled by valve operator 19 which receives air from any convenient source. Motor means 18 may be a reversible air motor, although the principles of the instant invention can also be utilized with other types of motors. The output shaft of air motor 18 drives knurled tensioning wheel 26 through a suitable transmission situated within a gear housing 20. Air motor 18 and tensioning wheel 26 are operably connected by means of drive shaft 27 and are mounted on gear housing 20 which, in turn, is mounted for pivotal movement on pivot shaft 14. Supporting link 28 is also pivotally mounted on pivot shaft 14, and common drive shaft 27 for tensioning wheel 26 and ratchet wheel means 40 is journaled therein.

Figure 2:
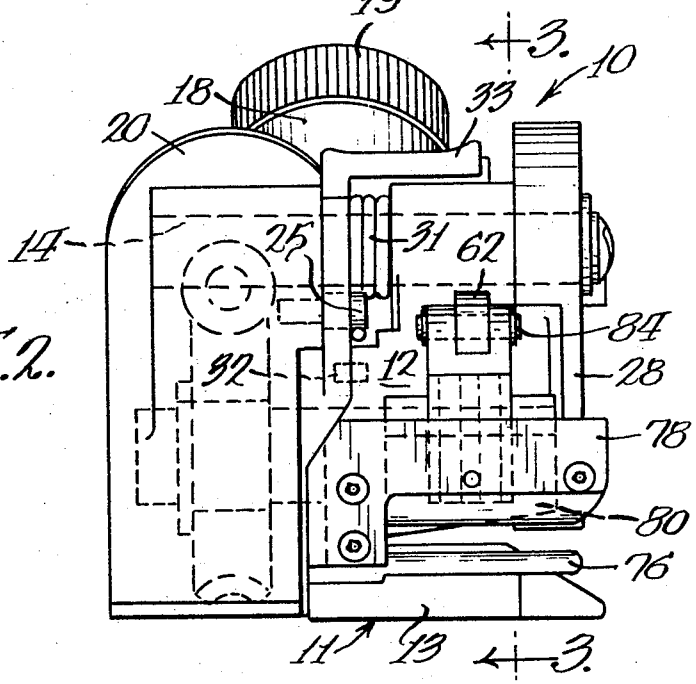
FIG. 2 is a frontal elevational view of the tool of FIG. 1 taken from the left side of the tool as shown in FIG. 1.

As shown in FIG. 2, torsion spring 31 provides an additional downward force urging tensioning wheel 26 against the strap. Torsion spring 31 is carried on pivot shaft 14 and is connected to gear housing 20 and frame 11 by means of pin 25 and generally L-shaped member 33, respectively. Generally L-shaped member 33, pivotally mounted on upright portion 12 of frame 11 by pin 32 can also be made integral with upright portion 12, if desired, and provides an abutment for torsion spring 31.

The additional downward force provided by the torsion spring 31 urges tensioning wheel 26 against the strap and helps to start the tensioning. Additionally, after the cut-off cycle is completed, torsion spring 31 helps to hold the cut-off portion of strap in the tool.

As shown in FIGS. 3A through 3D, tensioning wheel 26 grips strap positioned within the tensioner and pulls the upper, outer, overlapping strap portion 34 through seal 38 when the motor 18 is energized to rotate tensioning wheel 26 in the direction indicated by arrow A. Excess strap 29 is pulled through seal 38 until strap segment 30 which circumscribes a package is tensioned to a predetermined tautness. Strap 30 and seal 38 can then be crimped to fix the produced joint in a conventional manner. As the tensioning wheel 26 bears down on strap 30, the lower overlapping strap portion 36 is held and gripped during the tensioning operation against serrated surface 39*a* on gripping block 39 which is mounted in base portion 13 of frame 11.

When strap is tensioned and sealed, shearing mechanism 74 is brought into operation. The shearing mechanism 74 includes a movable cutting block 76 which preferably is slidably mounted on frame 11 and floats on carrier spring 92, cutter housing 78, cutter blade 80, and a cutter link 82 connected at one end to a crank 62 by cutter link pin 84, and connected at the opposite end to cutter blade 80 by cutter pin 86. Cutting block 76 may also be cantilevered from cutter housing 78 or pivotally mounted on cutter housing 78, as desired. Cutter blade 80 preferably is slidably mounted, as will be discussed hereinbelow. Alternatively, cutter blade 80 could be pivotally mounted or can be a rolling blade which traverses the strap segment to be cut. Crank 62 also carries pawl 42 pivotally mounted thereon by means of ratchet link pin 44.

Shearing mechanism 74 is driven by ratchet wheel 40 which is mounted on drive shaft 27 and is driven simultaneously with tensioning wheel 26. In the preferred embodiment of this invention, ratchet wheel 40 is positioned and arranged with respect to tensioning wheel 26 such that pawl 42 cannot engage the teeth of ratchet wheel 40 when the wheel rotates in the tensioning direction which is illustrated by arrow A. However, when the wheel rotates in the opposite (cut-off) direction, illustrated by arrow B, pawl 42 can engage the teeth of ratchet wheel 40 and actuate cutter blade 80.

Pawl 42 has one end adapted to engage the teeth of ratchet wheel 40. The opposite end of pawl 42 has one end 52 of elastic pawl positioning means 50 attached thereto. Opposite end 54 of pawl positioning means 50 is attached to lobe means 56 which is also provided with shifting lever 58 fixedly secured thereto. Preferably elastic pawl positioning means 50 is connected to pawl 42 and lobe 56 in an overcenter arrangement so that lobe 56 locks by means of snap action over dead center in either the on-position or in the off-position.

Pawl positioning means 50 may be a spring means such as a tension spring. When shearing mechanism 74 is in the off-position and tensioning wheel 26 rotates in the tensioning direction, tension spring 50 holds pawl 42 out of engagement with ratchet wheel 40 and also holds lobe 56 against stop surface 57.

Figure 3A:
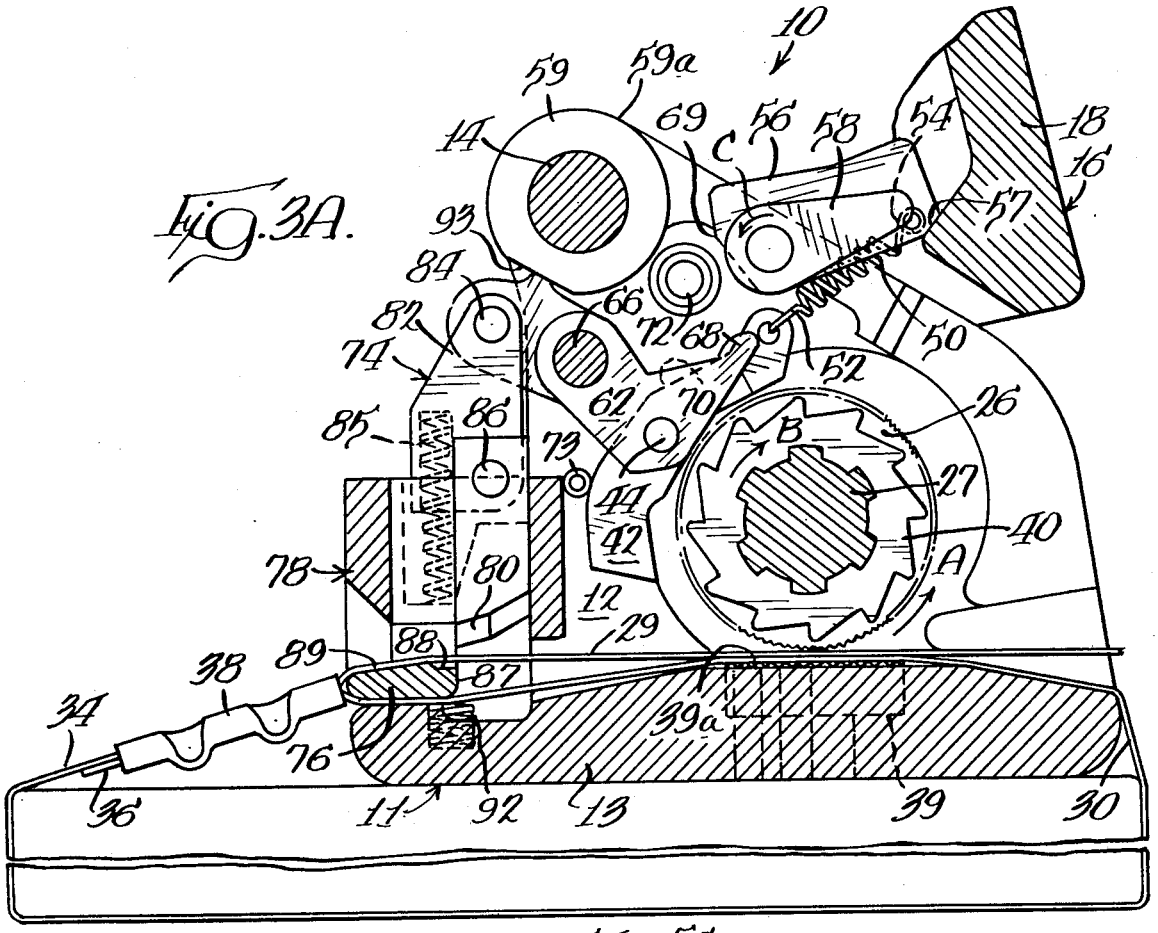
FIGS. 3A through 3D are fragmentary cross-sectional views of the tool of FIG. 1 taken along plane 3–3 in FIG. 2 and showing in sequence the operation of the tool during the strap cut-off.
Figure 3B:
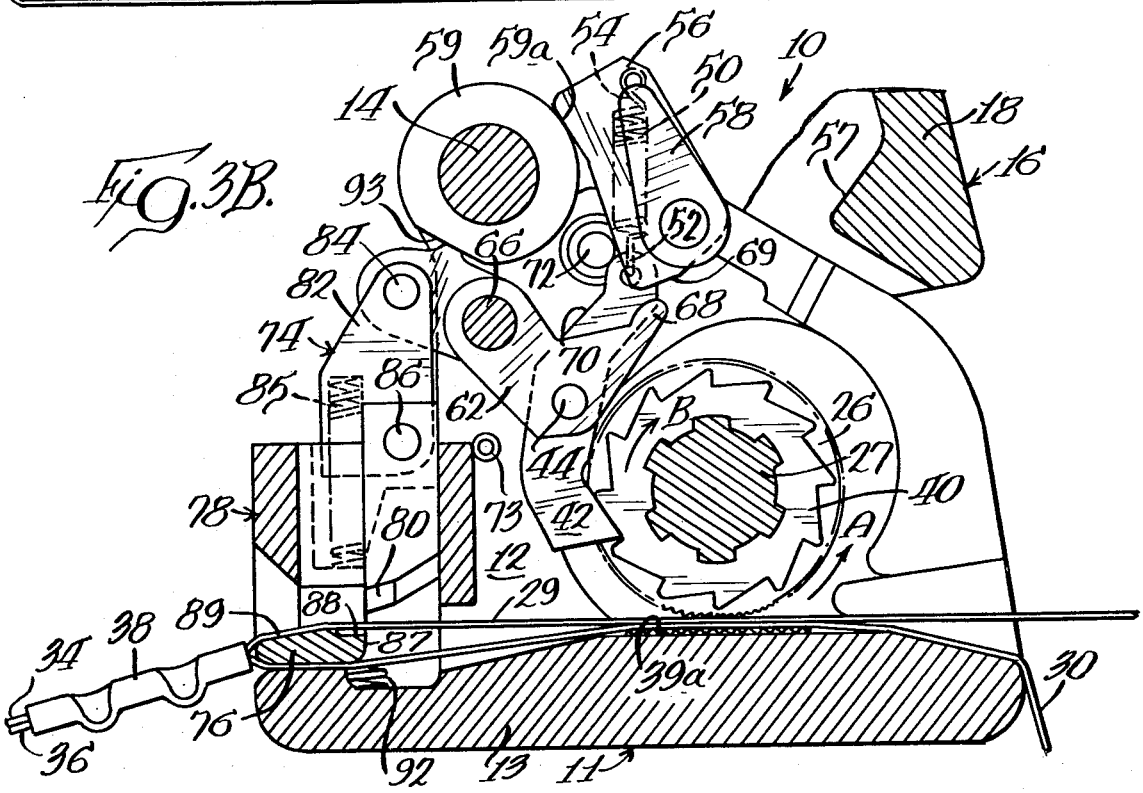

To bring shearing mechanism 74 into operation, lobe 56 is manually moved counterclockwise, in the direction of arrow C (FIG. 3A), to the on-position illustrated in FIG. 3B so that lobe 56 abuts circular boss 59 which provides stop surface 59*a* for lobe 56. Due to the overcenter arrangement, tension spring 50 holds lobe 56 against stop surface 59*a* on the generally circular boss 59. Tension spring 50 thereby biases pawl 42 into engagement with ratchet wheel 40, whereby the pawl is in a position to actuate cutter blade 80 when ratchet wheel 40 is rotated in direction B. Reversible air motor 18 is manually reversed, and the cut-off stroke is thus initiated.

Crank pin 66 pivotally mounts crank 62 on frame 11. As illustrated in FIGS. 1 and 3A – 3D, crank 62 is generally L-shaped and is pivotally connected at the end of one leg to cutter link 82 by cutter link pin 84. The end of the other leg of crank 62 has a projection 68.

Figure 3C:
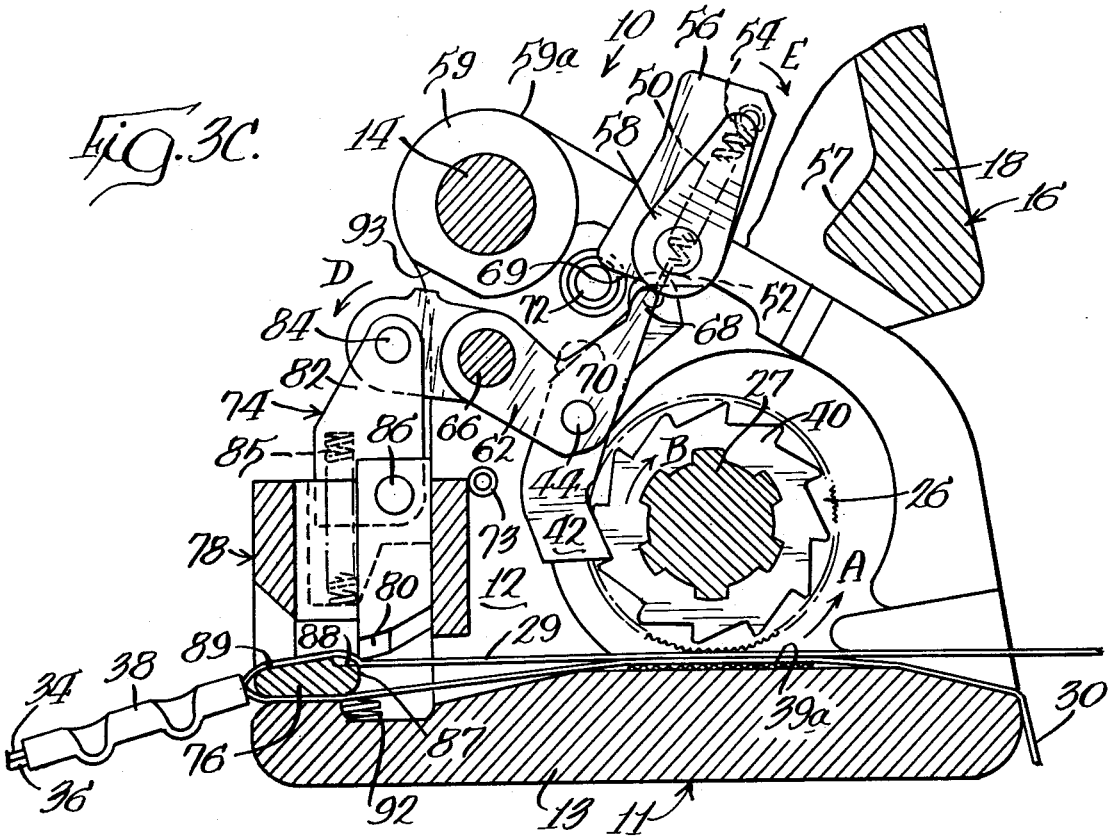
Figure 3D:
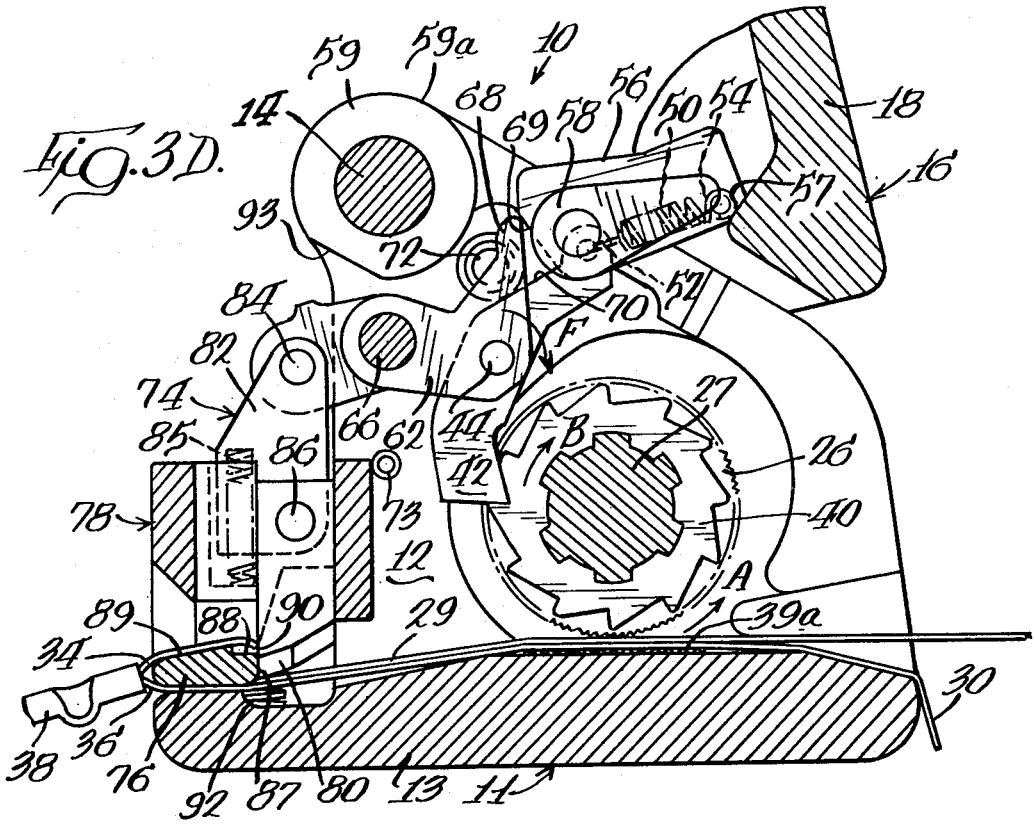

As ratchet wheel 40 raises pawl 42, crank 62 is rotated counterclockwise, in the direction of arrow D in FIG. 3C, thereby permitting cut-off to occur. Midway through the cutoff cycle, cam surface 69 on lobe 56 is engaged by projection 68 on crank 62 and lobe 56 is rotated clockwise in the direction of arrow E (FIG. 3C). Lobe 56 is thus pivoted from the on-position until end 52 of the tension spring, which is attached to the lobe 56, reaches an overcenter position relative to end 54 of the tension spring, which is attached to pawl 42, whereby tension spring 50 continues to rotate lobe 56 to the off-position until lobe 56 abuts stop surface 57, as illustrated in FIG. 3D. This insures that only a single cut-off stroke occurs each time lobe 56 is shifted to the on-position and a cut-off stroke is initiated.

At the end of the cut-off stroke, surface 70 of pawl 42 contacts roller 72 which is attached to upright portion 12 of frame 11. Roller 72 serves as a stop, and as is shown in FIG. 3D, pawl 42 is thereby rotated clockwise in the direction of arrow F (FIG. 3D) until it contacts roll pin 73 which stops its clockwise movement. Pawl 42 thereby disengages ratchet wheel 40 and returns to the position of FIG. 3A. This further insures that only a single cut-off stroke will occur, and automatically resets pawl 42 to the off-position.

As depicted in FIGS. 3C and 3D, as pawl 42 is raised by ratchet wheel 40, crank 62 is rotated counterclockwise in the direction of arrow D, thereby causing cutter link 82 and cutter blade 80 to move downwardly and shear the excess portion 29 of the strap. Cutter spring means 85 is thereby compressed, and causes strap cutter means 74 to return to the off-position. Stop surface 93 limits the clockwise movement of crank 62 after a cut-off stroke.

Cutter blade 80 moves vertically and substantially perpendicular relative to upper overlapping strap 34 which is to be sheared. Since it is the rotation of crank 62 that causes cutter blade 80 to move vertically, cutter link 82 provides a lost-motion-connection between crank 62 and cutter blade 80, both of which are pivotally connected by pin 86.

A feature of this invention is the safety with which tool 10 is operated. Tension spring 50 prevents pawl 42 from engaging ratchet wheel 40 unless the operator of tool 10 intentionally decides to cut the strap by moving lobe 56 from the off-position to the on-position. By doing so, only a single cut-off stroke occurs, and pawl 42 and lobe 56 are automatically returned to the off-position. If an additional cut-off stroke is desired, cut-off lever 58 must be manually moved to the cut-off position.

A further feature of the present invention is the configuration of cutting block 76. Cutting block 76 has a cutting edge 87 positioned transverse to the tensioning direction of the strap, and preferably facing toward tensioning wheel 26. Cutting block 76 is provided with a chamfer 88 at one end of the upper face 89 and along cutting edge 87. Since the overlapping strap portions 34 and 36 are fed into tool 10 so that floating cutting block 76 slidably mounted on frame 11 and supported by carrier spring 92 is positioned therebetween as illustrated in FIG. 3D, chamfer 88 has the advantage of causing cut edge 90 of strap 34 to bend downwardly upon being cut. This is a safety feature minimizing the exposure of the sharp cut edge 90 of the strap. During strap cut-off, lower inner strap portion 36 is held against base portion 13 of frame 11 by floating cutting block 76 which functions as a clamping means for preventing sideways movement of sealed strap portions 34 and 36 as the cutting blade engages strap portion 34.

Figure 4:
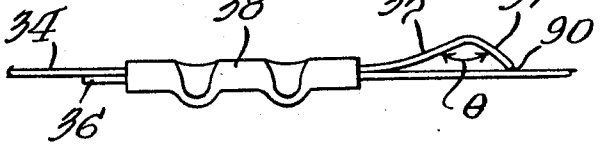
FIG. 4 is a side elevational view of the strap and seal after cut-off.

Referring to FIG. 4, outer and inner overlapping strap porions 34 and 36 are retained in fixed position by seal 38 surrounding the overlapping strap portions. The outer strap 34 has distal end 35 protruding outwardly from seal 38 and the terminal portion 37 of outer strap 34 has a bend directing terminal portion 37 toward inner overlapping strap portion 36. Preferably, the included angle $\theta$ between distal end 35 and terminal portion 37 is less than about 180°. More preferably, the included angle $\theta$ is less than about 150°. It is particularly preferred to have a bend in outer strap portion 34 which causes the terminal portion 37 to abut the inner overlapping strap portion 36.

Another feature of chamfer 88 is the protection afforded to cutting edge 87 of cutting block 76 during the tensioning operation, because strap portion 34 is held away from cutting edge 87 until such time when a strap segment 30 is to be cut off, thereby minimizing wear of cutting edge 87 as the strap is tensioned.

Yet another feature of this invention is that the time between engagement of pawl 42 by ratchet wheel 40 and tension release on the strap can be conveniently controlled by selecting the number of serrations (teeth) on the ratchet wheel. The lower the number of serrations, the greater the time period between ratchet engagement of the pawl and tension release. Tension release before cut-off is particularly important when plastic strap is being used in order to avoid shattering of the strap.

In operation, tool 10 is initially in the position illustrated in FIG. 3A wherein tension spring 50 holds pawl 42 out of engagement with ratchet wheel 40. Strap 30 circumscribes a package and has upper and lower overlapping portions 34 and 36 on opposite sides of cutter block 76 and through a seal 38 which is initially uncrimped. Reversible motor means 18 is actuated and tensioning wheel 26 grips the strap and rotates in the direction of arrow A, pulling upper strap portion 34 through seal 38. At the same time lower strap portion 36 is held in place by the coaction of the gripping block 39 and the tensioning wheel 26. The strap is tensioned to a predetermined tautness and seal 38 is crimped.

As shown in FIG. 2, lobe 56 is manually moved in the direction of arrow C to the on-position. Tension spring 50 thereby biases pawl 42 into engagement with ratchet wheel 40, which enables pawl 42 to actuate cutter blade 80. Cut-off is initiated by manually reversing reversible air motor 18, so that ratchet wheel 40 rotates in the direction of arrow B.

During the cut-off cycle, pawl 42 is raised by the ratchet wheel 40, as can be seen in FIG. 3C, and crank 62 is rotated in the direction of arrow D. Cam surface 69 on lobe 56 is engaged by projection 68 on crank 62 and lobe 56 is rotated in the direction of arrow E from the on-position until it reaches an overcenter position relative to pawl 42, whereby tension spring 50 continues to rotate lobe 56 to the off-position (FIG. 3D).

The rotational movement of the crank as the pawl 42 is raised by ratchet wheel 40 causes cutter link 82 and cutter blade 80 to move downwardly and shear the excess portion 29 of the upper strap 34. The cutter spring means 85 is compressed by the downward movement of cutter link 82 and urges strap cutter means 74 to the off-position. The rotational movement of crank 62 after a cut-off stroke is limited by stop surface 93.

When the cut-off stroke is completed, FIG. 3D, surface 70 of pawl 42 contacts roller 72 which serves as a stop. Pawl 42 is thereby rotated in the direction of arrow F until it contacts roll pin 73 which stops its clockwise movement. Pawl 42 thereby disengages ratchet wheel 40. The cut-off cycle is completed, and tool 10 is automatically returned to the off-position, whereupon another cycle of tensioning, crimping, and cutting-off may be commenced.

While this invention is susceptible of embodiment in many different forms, there is shown in the drawings and described herein in detail preferred embodiments of the invention, with the understanding that the present disclosure is to be considered as an exemplification of the principles of the invention and is not intended to limit the invention to the embodiments illustrated.

I claim:

1. In a strap segment having outer and inner overlapping portions retained in fixed position solely by a crimped seal surrounding said overlapping portions and having the distal end of said outer overlapping portion protruding from said seal, the improvement which comprises a bend between the distal end and the terminal portion of said outer overlapping portion and which bend is axially spaced from the adjacent end of said seal and directing the terminal portion toward a flat underlying region of the inner overlapping portion of strap.

2. The improvement as defined in claim 1, wherein the included angle between said distal end and the terminal portion thereof is less than about 180°.

3. The improvement as defined in claim 1, wherein said included angle is less than about 150°.

4. The improvement as defined in claim 1, wherein said terminal portion abuts said inner overlapping portion of strap.

* * * * *